US008719969B2

(12) United States Patent
Curtis

(10) Patent No.: US 8,719,969 B2
(45) Date of Patent: May 13, 2014

(54) PROTECTIVE GARMENT WITH THERMAL LINER HAVING VARYING MOISTURE ATTRACTION

(75) Inventor: Nicholas J. Curtis, Middletown, OH (US)

(73) Assignee: Lion Apparel, Inc., Dayton, OH (US)

( * ) Notice: Subject to any disclaimer, the term of this patent is extended or adjusted under 35 U.S.C. 154(b) by 1143 days.

(21) Appl. No.: 12/491,660

(22) Filed: Jun. 25, 2009

(65) Prior Publication Data

US 2009/0320176 A1 Dec. 31, 2009

Related U.S. Application Data

(60) Provisional application No. 61/076,254, filed on Jun. 27, 2008.

(51) Int. Cl.
*A62B 17/00* (2006.01)

(52) U.S. Cl.
USPC ..... 2/458; 2/97

(58) Field of Classification Search
USPC ..... 2/98, 93, 458, 455, 456, 87, 81, 82, 85
See application file for complete search history.

(56) References Cited

U.S. PATENT DOCUMENTS

| | | | | |
|---|---|---|---|---|
| 3,925,823 | A | 12/1975 | Kupferman | |
| 4,194,041 | A | 3/1980 | Gore et al. | |
| 4,502,153 | A | 3/1985 | Lapedes et al. | |
| 5,001,781 | A | 3/1991 | Grilliot et al. | |
| 5,136,723 | A | 8/1992 | Aldridge et al. | |
| 5,236,769 | A | 8/1993 | Paire | |
| 5,640,718 | A | 6/1997 | Aldridge | |
| 5,691,040 | A | 11/1997 | Barbeau et al. | |
| 5,697,101 | A | 12/1997 | Aldridge | |
| 5,819,316 | A | 10/1998 | Aldridge | |
| 5,860,163 | A | 1/1999 | Aldridge | |
| 5,884,332 | A | 3/1999 | Snedeker | |
| 5,885,912 | A | 3/1999 | Bumbarger | |
| 5,890,226 | A * | 4/1999 | Snedeker et al. | 2/97 |
| 5,920,905 | A | 7/1999 | Aldridge | |
| 5,928,971 | A | 7/1999 | Ellis et al. | |
| 5,933,865 | A | 8/1999 | Aldridge | |
| 5,983,409 | A | 11/1999 | Aldridge et al. | |
| 5,996,122 | A | 12/1999 | Aldridge et al. | |
| 6,317,889 | B1 | 11/2001 | Reilly et al. | |
| 6,430,754 | B1 * | 8/2002 | Taylor et al. | 2/458 |
| 6,658,670 | B1 | 12/2003 | Grilliot et al. | |
| 6,806,215 | B2 | 10/2004 | Grilliot et al. | |
| 6,983,490 | B1 | 1/2006 | Lewis et al. | |
| 2002/0069453 | A1 | 6/2002 | Kelleher et al. | |
| 2004/0154084 | A1 | 8/2004 | Aldridge et al. | |
| 2004/0266297 | A1 | 12/2004 | Schierenbeck et al. | |
| 2005/0144695 | A1 | 7/2005 | Aldridge et al. | |
| 2007/0136923 | A1 | 6/2007 | Aldridge | |
| 2009/0094726 | A1 | 4/2009 | Grilliot et al. | |

OTHER PUBLICATIONS

PCT, International Search Report and Written Opinion, International Application No. PCT/US2009/048625 (16 pages) (Oct. 1, 2009).
PCT, International Preliminary Report on Patentability, International Application No. PCT/US2009/048625 (Jan. 13, 2011).
"Technical Data. Thermal Protective Performance Commonly known as the TPP Test," by Globe Manufacturing Company, LLC, pp. 1-2, http://www.ppe101.com/data/TPP-Guidance.doc Apr. 2008.
Patent Examination Report No. 1, Australian Application No. 2009262162 (Nov. 8, 2012).
Patent Examination Report No. 2, Australian Application No. 2009262162 (Jul. 24, 2013).

* cited by examiner

*Primary Examiner* — Danny Worrell
(74) *Attorney, Agent, or Firm* — Thompson Hine L.L.P.

(57) ABSTRACT

A protective garment including an outer shell, a thermal barrier having a thermal protection performance of at least about twenty, and a moisture barrier positioned between the outer shell and the thermal barrier. The thermal barrier includes an outer layer, an inner layer, and an intermediate layer positioned between the outer and inner layers. The outer layer is positioned adjacent to the moisture barrier, and moisture is more attracted to the intermediate layer than to the outer layer.

30 Claims, 2 Drawing Sheets

PROTECTIVE GARMENT WITH THERMAL LINER HAVING VARYING MOISTURE ATTRACTION

This application claims priority to U.S. Provisional Application Ser. No. 61/076,254, filed Jun. 27, 2008, the entire contents of which are incorporated by reference herein.

This application relates to protective garments, and more particularly, to protective garments with a thermal barrier having varying moisture attraction, such as certain hydrophobic and/or hydrophilic qualities.

BACKGROUND

Protective or hazardous duty garments are used in a variety of industries and settings to protect the wearer from hazardous conditions such as heat, smoke, cold, sharp objects, chemicals, liquids, fumes and the like. Such protective or hazardous duty garments are often used in adverse conditions. In addition, the wearers of such garments are typically placed under physical strain by carrying heavy gear and equipment. Wearers seek to avoid fatigue to remain mentally sharp and physically ready to carry out tasks.

Wearers of protective garments are often exposed to liquids, such as water or other liquids used during firefighting activities, or water in the form of perspiration. For example, an active and fully geared firefighter can perspire at a rate of 1200 to 1800 grams per hour as his or her body strives to maintain metabolic balance. Water or moisture (including any predominantly aqueous liquid) can alter the performance of the protective garment, such as by reducing the thermal insulation of the garment, and/or reducing ability of water vapor to pass outwardly through the selectively permeable moisture barrier of the garment. Moreover, if the moisture is left on the wearer's skin and not permitted to evaporate, the wearer may experience physical discomfort.

SUMMARY

In one embodiment, the invention is a protective garment including an outer shell, a thermal barrier having a thermal protection performance of at least about twenty, and a moisture barrier positioned between the outer shell and the thermal barrier. The thermal barrier includes an outer layer, an inner layer, and an intermediate layer positioned between the outer and inner layers. The outer layer is positioned adjacent to the moisture barrier, and moisture is more attracted to the intermediate layer than to the outer layer.

DETAILED DESCRIPTION

Figure 1:
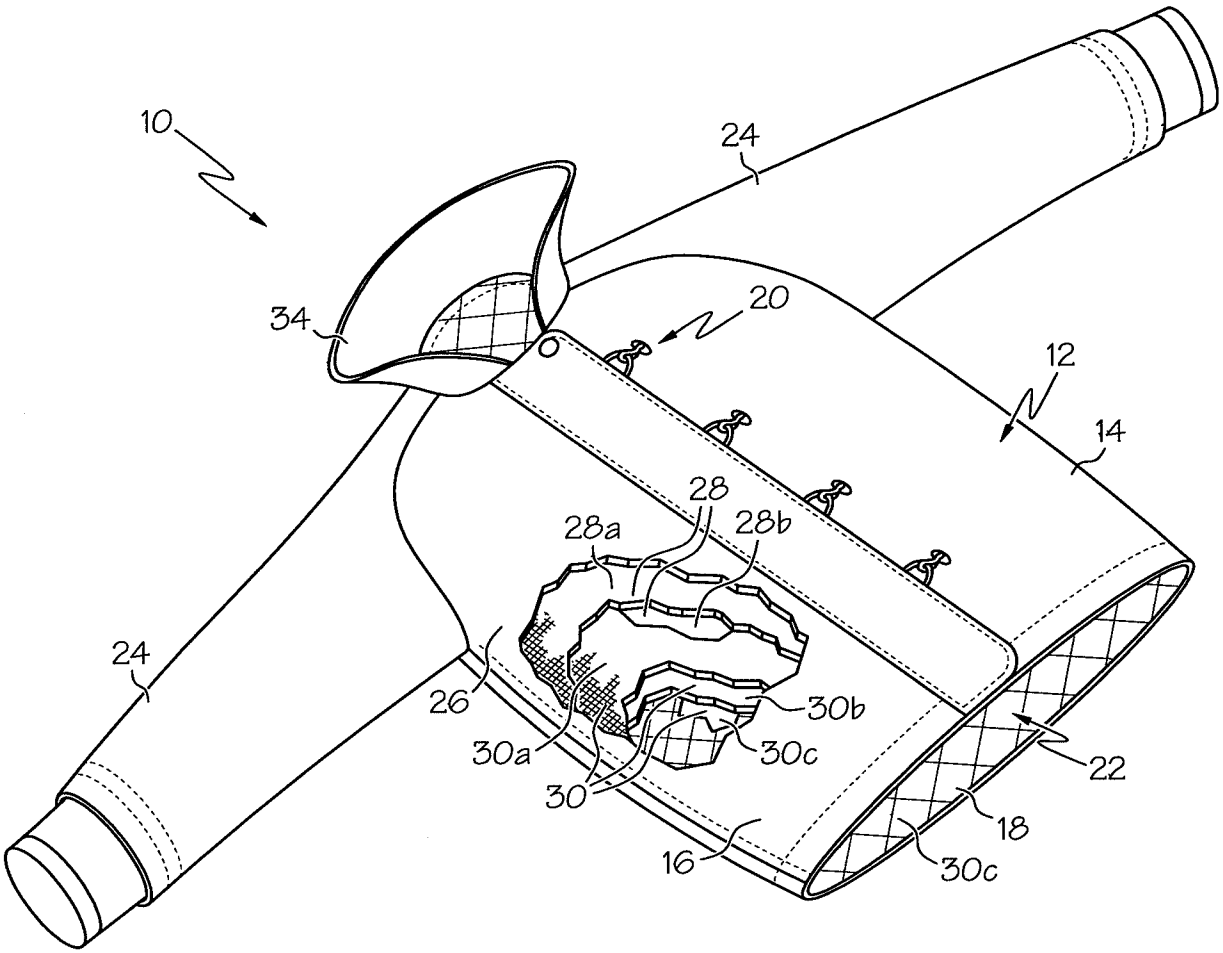
FIG. 1 is a front perspective view of one embodiment of the garment of the present invention, shown in the form of a coat with certain layers cut away for illustrative purposes.

FIG. 1 illustrates a protective or hazardous duty garment 10 in the form of a firefighter's coat, generally designated 10. The garment 10 includes a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO® fastening material) combinations of these components or the like. The body portion 12 may define a torso cavity 22 that is shaped to receive a wearer's torso therein. The garment 10 may include a pair of arms or sleeves 24 coupled to and extending generally outwardly from the body portion 12 and shaped to receive a wearer's arms therein.

Figure 2:
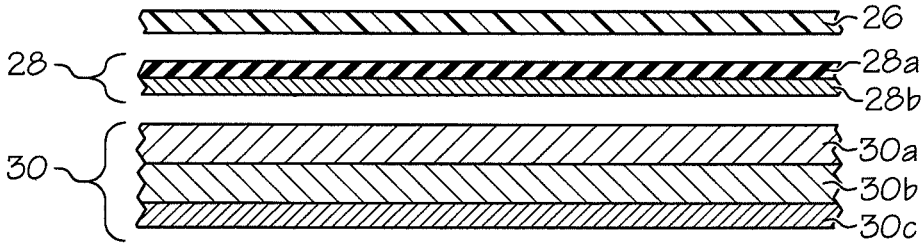
FIG. 2 is a side, exploded cross-sectional view of the garment of FIG. 1.
Figure 3:
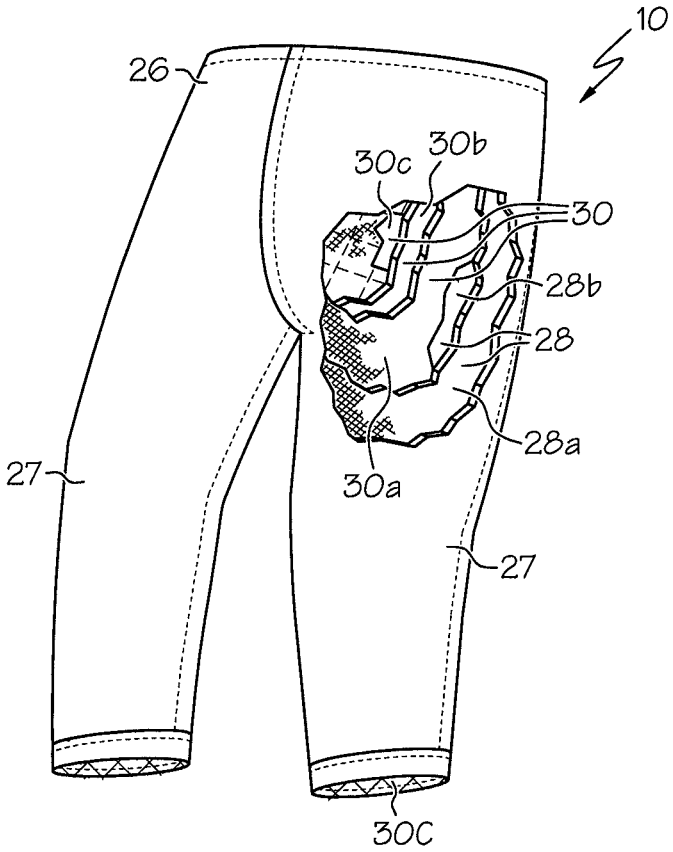
FIG. 3 is a front perspective view of the garment of the present invention, shown in the form of a pair of trousers with certain layers cut away for illustrative purposes.

As shown in FIG. 3, the garment 10 may also take the form of a pair of trousers, including a pair of legs 27 shaped to receive a wearer's legs therein. Moreover, the garment 10 can also take various other forms, such as coveralls, jumpsuits, vests, etc. Each of these garments 10 may have the layers/materials described below (i.e. shown in FIG. 2 and in the cut-away portions of FIGS. 1 and 3) to provide the accompanying benefits.

The garment 10 may include various layers through its thickness to provide heat, moisture and abrasion resistant qualities to the garment 10 so that the garment 10 can be used as a protective, hazardous duty, and/or firefighter garment. For example, in one embodiment the garment 10 may include an outer shell 26, a moisture barrier 28 located inside of and adjacent to the outer shell 26, and a thermal liner or barrier 30 located inside of and adjacent to the moisture barrier 28. Thus, in the illustrated configuration, the moisture barrier 28 is positioned between the outer shell 26 and the thermal barrier 30.

The outer shell 26 may be made of or include a variety of materials that are woven, knitted, or otherwise formed of high tenacity, flame resistant fibers. For example, the outer shell 26 may be made of a flame, tear, heat and abrasion resistant material such as a compact weave of aramid fibers and/or polybenzamidazole fibers. Commercially available aramid materials include NOMEX® and KEVLAR® fibers (both trademarks of E.I. DuPont de Nemours & Co., Inc. of Wilmington, Del.), and commercially available polybenzamidazole fibers include PBI® fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials, such as BASOFIL® textile cloth sold by Basofil Fibers, LLC of Enka, N.C., or ZYLON® textile materials sold by Toyo Boseki Babushiki Kaisha of Osaka, Japan. The material of the outer shell 26 may have a weight of, for example, between about 5-10 oz/yd$^2$.

The outer shell 26 may exhibit some resistance to the absorption of water/moisture, since absorption of water/moisture increases the weight of the garment 10, alters the thermal conductivity of the garment 10, and decreases the effectiveness of the moisture barrier 28, as will be described in greater detail below. If desired, the outer shell 26 may be coated with a durable, water repellent finish (i.e. a polymer finish, such as perfluorohydrocarbon, such as TEFLON® finish sold by E.I. Du Pont de Nemours and Company of Wilmington, Del.). However, the outer shell 26 need not necessarily be so treated to resist the absorption of water.

The moisture barrier 28 and thermal barrier 30 may be generally coextensive with the outer shell 26, or spaced slightly inwardly from the outer edges of the outer shell 26 (i.e., spaced slightly inwardly from the outer ends of the sleeves 24, the collar 34 and from the upper and lower edge of the coat/trousers, etc.) to provide moisture and thermal protection throughout the garment 10.

The moisture barrier 28 may include a semi-permeable membrane layer 28*a* and a substrate 28*b*. The membrane layer 28*a* may be generally moisture vapor permeable but generally impermeable to liquid moisture. The membrane layer 28*a* may be made of or include expanded polytetrafluoroethylene ("PTFE") such as GORE-TEX®, CROSSTECH® or CHEMPAK® materials (all of which are trademarks of W.L. Gore & Associates, Inc. of Newark, Del.), polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded or adhered to the substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight, and allow moisture vapor to freely pass therethrough. The substrate 28*b* may be woven, non-woven, spunlace or other materials.

In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*. Moreover, in the illustrated embodiment, the substrate layer 28*b* is located on only one side of the membrane layer 28*a*. However, a substrate layer 28*b* may be located on both sides of the membrane layer 28*a*, if desired, to improve durability or other performance parameters of the moisture barrier 28.

The moisture barrier 28 helps to prevent external moisture/water (i.e., that has breached the outer shell 26) from reaching the thermal barrier 30. If the thermal barrier 30 retains sufficient external moisture/water, the thermal barrier 30 becomes significantly more thermally conductive, which allows the external heat to be more easily transferred to the wearer. A moisture-laden thermal barrier 30 also adds significant weight, thus increasing fatigue of the wearer. Accordingly it is desired to limit the absorption of external moisture by the thermal barrier 30. In addition, by providing a "breathable" moisture barrier 28, vapor and dry heat can pass from the torso cavity 22, through the moisture barrier 28, and out of the garment 10.

However, when either side of the moisture barrier 28 becomes sufficiently exposed to moisture, the moisture barrier 28 may no longer allow vapor to pass therethrough. More particularly, when a continuous sheet of water/moisture (i.e. formed by capillary or attractive forces of the water, or by sheer volume of the water/moisture) coats one or both sides of the moisture barrier 28, the moisture barrier 28 may be considered to be "wetted out," and the microscopic openings of the membrane layer 28*a* may be sealed or blocked (or the moisture barrier 28 otherwise adversely effected) such that water/moisture vapor cannot pass through the moisture barrier 28. When the thermal barrier 30 is wet or saturated with water/moisture, the thermal barrier 30 may contribute to wetting out of the moisture barrier 28 (i.e. by direct physical contact and/or capillary action between the thermal barrier 30 and moisture barrier 28, or by causing the air adjacent to the moisture barrier 28 to become saturated such that moisture condenses on the moisture barrier 28, etc.)

Accordingly, the thermal barrier 30 may be configured to reduce wetting out of the moisture barrier 28. In one embodiment, the thermal barrier 30 includes three layers: a first, or outer, or dry layer 30*a*, a second, or middle, or reservoir layer 30*b*, and a third or inner, or face cloth layer 30*c*. The dry layer 30*a* may be positioned adjacent to the moisture barrier 28 (i.e. positioned between the moisture barrier 28 and the reservoir layer 30*b*) and can be made of knitted, non-woven or woven materials and may resist absorption of water/moisture.

For example, the dry layer 30*a* may be relatively thick (i.e. between about 1/64"-3/16") layer of batting, or felt or needled non-woven bulk or batting material 30*a*. The material of the dry layer 30*a* can include aramid fiber batting (such as NOMEX® batting), an aramid blend of non-woven material, an aramid spun-lace material, an aramid needlepunch material, an aramid non-woven material, an aramid blend needlepunch material, an aramid blend batting material, meta-aramid materials, para-aramid materials, KERMEL™ thermostable organic polymeric material sold by Kermel SAS of Colmar, France, TWARONR® synthetic fibers sold by Teijin Aramid B.V. Ltd. of Arnhem, Netherlands, KEVLAR® material, foam (either open cell or closed cell), or combinations of these materials which may be imparted with flame and heat resistant properties.

The dry layer 30*a* may be made of materials, or treated, such that the dry layer 30*a* is hydrophobic or generally hydrophobic and is configured to resist the absorption of water/moisture. The dry layer 30*a* may be made of inherently hydrophobic or generally hydrophobic materials, or made of materials which are treated to be hydrophobic or generally hydrophobic. A material/treatment may be considered to be hydrophobic, generally hydrophobic, water-repellant, or nonhydrophilic, when the material/treatment has a contact angle with water/moisture of greater than about 90°. In this case, the attractive or adhesive forces within a drop of water are stronger than the attractive or adhesive forces between the water and the material/treatment. This aversion of water to the hydrophobic material/treatment causes the drop of water to form into a somewhat spherical or closed shape, rather than spread out and be absorbed into or attracted to the hydrophobic material/treatment. If desired, the hydrophobic material/treatment may have a contact angle of less than 150° such that the materials/treatment are not superhydrophobic, although the material/treatment may be superhydrophobic in some cases.

A layer/liner, such as layer 30*a*, may also, or instead, be considered to be hydrophobic or generally hydrophobic if the layer/liner can gain and retain no more than 100% (or 50% in another embodiment) of its weight in moisture. In this manner it should be clear that a layer/liner need not entirely consist of hydrophobic materials to be considered hydrophobic as a whole, and a hydrophobic layer/liner could in fact include some "neutral" or even some hydrophilic materials and still be considered hydrophobic or generally hydrophobic. The same principles apply, of course, to a hydrophilic layer/liner.

If the dry layer 30*a* is made with a material that is not inherently hydrophobic or generally hydrophobic (such as an aramid spunlace or aramid nonwoven material) the dry layer 30*a* may be treated with a durable water-repellant finish, such as, in one embodiment, perfluorohydrocarbon. The durable water-repellant finish should be sufficiently durable that is can withstand at least five launderings (according to appropriate NFPA standards, EN standards, or the like) without substantial diminution in its water repellency (i.e. in one case, such that the water repellant finish loses no more than 10% of its ability to prevent water absorption).

The reservoir layer 30*b* may be positioned between the dry layer 30*a* and the face cloth layer 30*c*, and may be made of materials, or treated, such that the reservoir layer 30*b* is hydrophilic or generally hydrophilic, and thus configured to retain water/moisture in the layer 30*b*. In this case, materials of the reservoir layer 30*b* may have a contact angle of greater than 900 such that the attractive or adhesion forces within a drop of water/moisture are weaker than those between the water/moisture and the hydrophilic (or non-water repellent or non-hydrophobic) materials. Alternately, or in addition, the layer 30*b* may be considered to be hydrophilic or generally hydrophilic if the layer/liner can gain and retain at least twice its weight in moisture.

The reservoir layer 30*b* can be made of any of the materials described above for the dry layer 30*a*, but may also include cotton, acrylic, or viscose. In some cases, the thermal barrier 30 may lack any significant polymer filler material, such as a superabsorbent polymer, including a cross-linked polyacrylamide. In one embodiment, the reservoir layer 30*b* includes 50%, or at least about 25%, by weight of absorbent hydrophilic material or fibers, such as Lenzing FR viscose. These materials are absorbent and include interstices to help store and retain moisture. The balance of the reservoir layer 30*b* can consist of adsorbent hydrophilic material with flame and heat resistant properties, such as KYNOL™ material sold by Gun Ei Chemical of Japan, meta aramid, aramid, or para aramid materials such as NOMEX®, KERMEL®, TWARON®, KEVLAR® or TEIJINCONEX® sold by Teijin Techno Products Limited of Osaka, Japan. These adsorbent materials help to wick up moisture such that it can be absorbed by the absorbent materials of the reservoir layer. The adsorbent and absorbent materials of the reservoir layer 30*b* may be blended together to form a generally homogeneous mixture.

The inner layer 30*c* can be the innermost layer of the garment (i.e. positioned immediately adjacent to a wearer or the wearer's clothing), or positioned adjacent to an inner liner (not shown). The inner liner 30*c* can be a weave of light weight aramid material, and may be made of any of the materials described above for the reservoir layer 30*b*, dry layer 30*a*, or substrate 28*b* of the moisture barrier 28. The inner layer 30*c* may be made of or include some hydrophilic or generally hydrophilic material (or material treated to be hydrophilic) to wick moisture away from the wearer. Thus the inner layer 30*c* may be hydrophilic or generally hydrophilic, but may be less hydrophilic than the reservoir layer 30*b* since too much wicking of moisture may cause the inner layer 30*c* to become saturated.

The inner layer 30*c* may form the inner-most layer of the garment 10, and therefore is desired to present a comfortable surface to the wearer, and protects the moisture barrier 28 and other layers 30*a*, 30*b* of the thermal barrier 30 from abrasion and wear. If desired, at least the layers 30*b* and 30*c* may be directly joined together to form an integral liner/layer of the garment which improves ease of repair and replacement, and/or help to retain moisture in the reservoir layer 30*b*. Alternately, or in addition, all three layers 30*a*, 30*b*, 30*c* may be joined together to form an integral liner/layer 30. The layers 30*a*, 30*b*, 30*c* can be joined together by various means, such as quilting, stitching, adhesives, combinations of these techniques or otherwise, although the layers 30*a*, 30*b*, 30*c* may remain separate if desired. In some cases, the thermal barrier 30 may be joined to the moisture barrier 28 to form an integral inner liner component.

Rather than each layer 30*a*, 30*b*, 30*c* being strictly identified as hydrophobic/hydrophilic, each layer 30*a*, 30*b*, 30*c* may be more hydrophobic/hydrophilic than other layers and still operate in the desired manner. For example, the thermal layer 30 may include a reservoir layer 30*b* that is more hydrophilic than the dry layer 30*a* and/or the inner layer 30*c*, and an inner layer 30*c* that is more hydrophilic than the dry layer 30*a*. Conversely, the dry layer 30*a* may be more hydrophobic than the inner layer 30*c*, which in turn may be more hydrophobic than the reservoir layer 30*b*. In this manner, moisture presented to the thermal barrier 30 from inside the garment 10 (i.e. in the form of perspiration) is transported through the inner layer 30*c* and is held within the reservoir layer 30*b* until conditions of interior pressure and/or exterior dryness allow moisture (in the form of water vapor) to pass further outward through the dry layer 30*a* and the breathable moisture barrier 28.

By maintaining a relatively hydrophobic dry layer 30*a* facing the moisture barrier 28, wetting out of the inner surface of the moisture barrier 28 is prevented or reduced. In particular, because the dry layer 30*a* generally repels, and does not retain, water/moisture, a relatively dry surface is presented to the inner surface of the moisture barrier 28 to prevent wetting out of the moisture barrier 28. In addition, the dry layer 30*a* allows moisture vapor/water vapor to pass therethrough. Accordingly, moisture/water stored in the reservoir 30*b* can pass through the dry layer 30*a* and moisture barrier 28 in vapor form, and exit the garment 10 to increase comfort and thermal insulation of the garment 10. If desired, no layers of the garment or other materials, particularly hydrophilic materials or layers, are positioned between the dry layer 30*a* and the moisture barrier 28 so that the dry layer 30*a* can provide a dry facing surface as desired.

In addition, as noted above the inner layer 30*c* may be hydrophilic or generally hydrophilic to help draw moisture away from the wearer. Because the reservoir layer 30*b* is more hydrophilic than the inner layer 30*c*, moisture is drawn or wicked from the inner layer 30*c* into the reservoir 30*b*, wherein the water/moisture is stored until it can be vented through the moisture barrier 28.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28. In this case, the orientation of the thermal barrier 30 would be reversed so that the dry layer 30*a* is the inner-most layer, facing the moisture barrier 28 to prevent wetting out of the moisture barrier 28. Moreover it should be understood that the garment 10 may include various arrangements of liners, barriers and materials, as desired, in which the various layers described herein are included, omitted, and/or rearranged.

The thermal barrier 30, as a whole, may trap air and possess sufficient loft to provide thermal resistance to the garment 10 to allow the garment to properly function as a firefighting garment. In one embodiment, the thermal barrier 30 (and/or the garment 10 as a whole) may have a thermal protection performance ("TPP") of at least about twenty or at least about ten, and/or the garment 10 as a whole may have a TPP of at least about thirty-five.

Each layer of the garment 10, and the garment 10 as a whole, may meet the National Fire Protection Association ("N.F.P.A.") 1971 standards for protective firefighting garments ("Protective Clothing for Structural Firefighting") (or equivalent standards set by European Committee for Standardization (also known as Comité Européen de Normalisation ("CEN")) which are entirely incorporated by reference herein. The NFPA standards specify various minimum requirements for heat and flame resistance and tear strength. For example, in order to meet the NFPA standards, the outer shell 26, moisture barrier 28 and thermal barrier 30 collectively, and individually, must be able to resist igniting, burning, melting, dripping and/or separation when exposed to a temperature of 500° F. for at least five minutes in a forced air oven. Furthermore, in order to meet the NFPA standards, all combined layers of the garment 10 must provide a thermal protective performance rating of at least thirty-five.

NFPA standards also require that the outer shell 26, moisture barrier 28, and thermal barrier 30 collectively, and individually, be sufficiently flame resistant to meet the flame test specified therein. Apparatus and procedures for determining flame resistance are in accordance with NFPA 1971, NFPA 1975 and ASTM D 6413, *Standard Test Method for Flame Resistance of Textiles* (*Vertical Test*), which is incorporated by reference herein. For example, each layer 26, 38, 30, and the garment 10 as a whole, should have a char length of not more than four inches, or under NFPA 1975 standards a char length of not more than six inches, and shall not melt or drip, when tested in the manner specified in the flame resistance test.

Although the invention is shown and described with respect to certain embodiments, it should be clear that modifications will occur to those skilled in the art upon reading and understanding the specification, and the present invention includes all such modifications.

What is claimed is:

1. A protective garment comprising:

an outer shell;

thermal barrier having a thermal protection performance of at least about twenty; and a moisture barrier positioned between said outer shell and said thermal barrier, wherein said moisture barrier is generally liquid impermeable and generally moisture vapor permeable, said thermal barrier including an outer layer, an inner layer, and an intermediate layer positioned between said outer and inner layers, wherein said outer layer is positioned adjacent to said moisture barrier, and wherein moisture is more attracted to said intermediate layer than to said outer layer.

2. The garment of claim 1 wherein said thermal barrier resists igniting, burning, melting, dripping or separation when exposed to a temperature of 500° F. for at least five minutes.

3. The garment of claim 1 wherein said outer layer is generally hydrophobic and said intermediate layer is generally hydrophilic.

4. The garment of claim 1 wherein said inner layer is generally hydrophilic.

5. The garment of claim 1 wherein said outer layer faces said moisture barrier with substantially no layers therebetween so that said thermal barrier presents a relatively dry surface to said moisture barrier.

6. The garment of claim 1 wherein said inner layer, said outer layer, and said intermediate layer are each discrete layers have a differing attraction to moisture than the other layers of said thermal barrier.

7. The garment of claim 1 wherein moisture is more attracted to said intermediate layer than to said inner layer.

8. The garment of claim 1 wherein moisture is more attracted to said inner layer than to said outer layer.

9. The garment of claim 1 wherein said inner layer is an inner face cloth forming the innermost surface of said garment and is configured to face a wearer when said garment is worn.

10. The garment of claim 9 wherein said inner layer is not directly coupled to said outer layer and said intermediate layer.

11. The garment of claim 1 wherein at least said intermediate layer is directly coupled to said outer layer to form a discrete layer of said garment.

12. The garment of claim 1 wherein said inner layer, said intermediate layer and said outer layer are directly coupled together form a discrete layer of said garment.

13. The garment of claim 1 wherein said outer shell resists igniting, burning, melting, dripping or separation when exposed to a temperature of 500° F. for at least five minutes.

14. The garment of claim 1 wherein the garment conforms with National Fire Protection Association 1971 Standards for Protective Firefighting Garments.

15. The garment of claim 1 wherein said outer layer of said thermal barrier is treated with perfluorohydrocarbon.

16. The garment of claim 1 wherein said thermal barrier is primarily made of aramid fiber batting, or an aramid blend of non-woven materials, or an aramid spun-lace material, or an aramid needlepunch material, or an aramid non-woven material, or an aramid blend needlepunch material, or an aramid blend batting material, or meta-aramid materials, or para-aramid materials, or thermostable organic polymeric material, or synthetic fibers, or combinations thereof.

17. The garment of claim 1 wherein said thermal liner lacks any polymer filler material.

18. The garment of claim 1 wherein said garment is a coat and said thermal barrier is formed in the shape of a coat, or wherein said garment is a pair of trousers and said thermal barrier is formed in the shape of a pair of trousers.

19. The garment of claim 1 wherein said intermediate layer includes a mixture of absorbent material and adsorbent material.

20. The garment of claim 1 wherein said intermediate layer includes at least about 25% absorbent material, and wherein substantially the remainder of said intermediate layer is made of adsorbent material.

21. A protective garment comprising:

an outer shell;

a thermal barrier; and a moisture barrier positioned between said outer shell and said thermal barrier, said thermal barrier including a generally hydrophobic outer layer, a generally hydrophilic inner layer and a generally hydrophilic intermediate layer positioned between said outer layer and said inner layer, said thermal barrier being configured such that said outer layer of said thermal barrier is positioned between said moisture barrier and said intermediate layer of said thermal barrier.

22. The garment of claim 21 wherein said thermal barrier has a thermal protection performance of at least about twenty.

23. The garment of claim 21 wherein said inner layer is less hydrophilic than said intermediate layer.

24. The garment of claim 21 wherein said thermal barrier resists igniting, burning, melting, dripping or separation when exposed to a temperature of 500° F. for at least five minutes.

25. A protective garment comprising:

a moisture barrier; and a thermal barrier positioned adjacent to said moisture barrier and having a thermal protection performance of at least about twenty, said thermal barrier including a generally hydrophobic layer and a generally hydrophilic layer, said thermal barrier lacking a superabsorbent polymer, wherein said generally hydrophobic layer faces said moisture barrier.

26. The garment of claim 24 wherein said hydrophobic layer is positioned between said hydrophilic layer and said moisture barrier.

27. The garment of claim 24 further comprising an outer shell, wherein said moisture barrier is positioned between said outer shell and said thermal barrier.

28. The garment of claim 22 wherein said hydrophilic layer includes first and second opposed sides, and wherein said hydrophobic layer is positioned on said first side of said hydrophilic layer, and wherein the thermal barrier includes a supplemental layer positioned on the second side of said hydrophilic layer, and wherein said supplemental layer is less hydrophilic than said hydrophilic layer.

29. The garment of claim 22 wherein said thermal barrier resists igniting, burning, melting, dripping or separation when exposed to a temperature of 500° F. for at least five minutes.

30. A protective garment comprising:

a moisture barrier; and a thermal barrier positioned adjacent to said moisture barrier, said thermal barrier including a generally hydrophobic layer and a generally hydrophilic layer, wherein said generally hydrophobic layer faces said moisture barrier, wherein said thermal barrier resists igniting, burning, melting, dripping or separation when exposed to a temperature of 500° F. for at least five minutes.

* * * * *